US006756327B2

(12) United States Patent
Martin

(10) Patent No.: US 6,756,327 B2
(45) Date of Patent: Jun. 29, 2004

(54) LOOP FASTENING COMPONENT MADE FROM THERMALLY RETRACTED MATERIALS

(75) Inventor: Timothy R. Martin, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 69 days.

(21) Appl. No.: 09/964,291

(22) Filed: Sep. 26, 2001

(65) Prior Publication Data

US 2002/0059705 A1 May 23, 2002

Related U.S. Application Data

(60) Provisional application No. 60/244,529, filed on Oct. 31, 2000.

(51) Int. Cl.[7] ..... B32B 3/06; B32B 5/26; A44B 18/00

(52) U.S. Cl. ..... 442/100; 428/99; 428/101; 24/442; 24/452; 442/381; 442/392; 442/414

(58) Field of Search ..... 442/381, 392, 442/414; 428/99, 101; 24/442, 452

(56) References Cited

U.S. PATENT DOCUMENTS

| | | | | |
|---|---|---|---|---|
| 4,323,534 A | | 4/1982 | DesMarais | |
| 4,567,796 A | | 2/1986 | Kloehn et al. | |
| 4,663,220 A | | 5/1987 | Wisneski et al. | |
| 4,811,468 A | | 3/1989 | Yamada | |
| 4,834,738 A | | 5/1989 | Kielpikowski et al. | |
| 5,032,122 A | | 7/1991 | Noel et al. | |
| 5,093,422 A | | 3/1992 | Himes | |
| 5,256,231 A | | 10/1993 | Gorman et al. | |
| 5,304,599 A | | 4/1994 | Himes | |
| 5,326,612 A | | 7/1994 | Goulait | |
| 5,470,417 A | | 11/1995 | Goulait | |
| 5,554,239 A | | 9/1996 | Datta et al. | |
| 5,614,281 A | | 3/1997 | Jackson et al. | |
| 5,643,396 A | | 7/1997 | Rajala et al. | |
| 5,669,900 A | | 9/1997 | Bullwinkel et al. | |
| 5,707,468 A | * | 1/1998 | Arnold et al. | 156/62.6 |
| 5,707,707 A | | 1/1998 | Burnes et al. | |
| 5,773,120 A | | 6/1998 | Deka et al. | |
| 5,830,298 A | | 11/1998 | Jackson | |
| 5,849,003 A | | 12/1998 | Olsen et al. | |
| 5,858,515 A | | 1/1999 | Stokes et al. | |
| 5,884,374 A | | 3/1999 | Clune | |
| 5,888,607 A | | 3/1999 | Seth et al. | |
| 5,904,793 A | | 5/1999 | Gorman et al. | |
| 5,964,742 A | | 10/1999 | McCormack et al. | |
| 5,997,981 A | | 12/1999 | McCormack et al. | |
| 6,066,221 A | | 5/2000 | Marmon et al. | |
| 6,077,255 A | | 6/2000 | Hunter et al. | |

FOREIGN PATENT DOCUMENTS

| | | | |
|---|---|---|---|
| DE | 197 32 552 A 1 | 2/1999 | |
| EP | 0 862 868 A1 | 9/1998 | |
| EP | 0 893 075 A2 | 1/1999 | |
| FR | 2 632 830 | 12/1989 | A44B/18/00 |
| JP | 09158022 | 6/1997 | D04H/1/46 |
| JP | 10248614 | 9/1998 | A44B/18/00 |
| JP | 11061624 | 3/1999 | D04H/11/08 |
| JP | 2000234253 | 8/2000 | D04H/1/22 |

OTHER PUBLICATIONS

English translation of JP 11–061624 from Japanese Patent Office website.*

* cited by examiner

*Primary Examiner*—Cheryl A. Juska
(74) *Attorney, Agent, or Firm*—Pauley Petersen & Erickson

(57) ABSTRACT

A loop component of a hook and loop fastener made of a fibrous, thermally retracted material. A method of making the loop component includes heating one side of a fibrous, thermally retractable material to a high enough temperature to cause the material to retract, thereby bonding the fibers on that side while allowing the fibers on the opposite side to gather into loops.

8 Claims, 3 Drawing Sheets

LOOP FASTENING COMPONENT MADE FROM THERMALLY RETRACTED MATERIALS

CROSS REFERENCE TO RELATED APPLICATION

This application claims the benefit of U.S. Provisional Applicaton No. 60/244,529, filed 31 Oct. 2000.

FIELD OF THE INVENTION

This invention is directed to a loop component of a hook and loop fastener, and a method for making the loop component.

BACKGROUND OF THE INVENTION

A number of fastening systems, such as diaper fastening systems, incorporate a hook and loop system for easy fastening and release. The hook component typically includes a flat plastic sheet laminate with a number of protruding hooks that engage with a loop component having a number of loops protruding from a second flat plastic sheet. Various types of loop components can be made in a number of different ways. Methods for making loop components typically entail a number of steps in order to stabilize the loop component both during and after production. For example, methods involving creped loop materials and mechanically necked stretched materials require extra process steps to stabilize the web. Furthermore, softness of the loop component is sometimes sacrificed in order to improve a manufacturing process for making the loop component.

There is a need or desire for a loop component of a hook and loop fastener that can be made efficiently and retain its softness.

SUMMARY OF THE INVENTION

The present invention is directed to a loop component of a hook and loop fastener made of a thermally retracted material. The loop component is made by applying heat to one side of a thermally retractable web, thereby causing the material to retract. More specifically, the fibers are heated, drawn and then quenched in a drawn state, such that the fibers tend to retract. The retraction allows a second side of the web to gather into loops. Added stability is achieved on the heated side of the thermally retracted material by thermally bonding the fibers together.

For example, an S-weave bond pattern spunbond web can be passed under a hot air knife with sufficient heat to allow the material to retract. A vacuum applied to a forming wire during the process is then controlled, thereby allowing the web to move in the direction of retraction. A resulting loop component maintains the softness of the thermally retractable web and is retracted in a cross direction.

With the foregoing in mind, it is a feature and advantage of the invention to provide a loop component of a hook and loop fastener that is efficient to manufacture and maintains the softness of the raw material. It is another feature and advantage of the invention to provide an efficient method of making a loop component of a hook and loop fastener.

DEFINITIONS

Within the context of this specification, each term or phrase below will include the following meaning or meanings.

"Cross direction" refers to the width direction of a fabric, generally perpendicular to the direction in which it is or was produced.

"Machine direction" refers to the length direction of a fabric, in the direction in which it is or was produced.

"Polymers" include, but are not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and atactic symmetries.

"Releasably attached,""releasably engaged" and variations thereof refer to two elements being connected or connectable such that the elements tend to remain connected absent a separation force applied to one or both of the elements, and the elements being capable of separation without substantial permanent deformation or rupture. The required separation force is typically beyond that encountered while wearing the absorbent garment.

"Thermally retractable" refers to a material that retracts, or draws back, when exposed to a certain threshold of heat.

These terms may be defined with additional language in the remaining portions of the specification.

DETAILED DESCRIPTION OF THE PRESENTLY PREFERRED EMBODIMENTS

The present invention is directed to a loop component of a hook and loop fastener and a method of making the loop component. The loop component is made of a thermally retractable material.

This loop component is particularly suitable for use in fastening systems on disposable absorbent articles. Examples of such suitable articles include diapers, training pants, feminine hygiene products, incontinence products, other personal care or health care garments, including medical garments, or the like.

Figure 1:
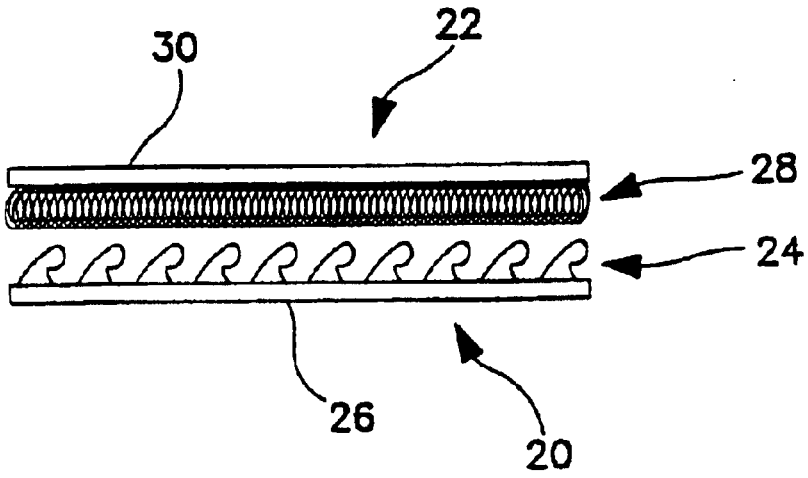
FIG. 1 is a side view of a hook component and a loop component prior to engagement with one another.

As shown in FIG. 1, a hook component 20 and a loop component 22 can be brought together to be releasably attached, or releasably engaged, to one another. The hook component 20 has a number of individual hooks 24 protruding generally perpendicularly from a resilient hook backing material 26. Similarly, the loop component 22 has a number of individual loops 28 protruding generally perpendicularly from a resilient loop material 30. The individual hooks 24 and the individual loops 28, when brought into contact with one another, engage with one another, with the hooks 24 latching onto the loops 28, until forcibly separated, thereby pulling the hooks 24 out of the loops 28.

A number of different hook components 20 are suitable for use with the loop component 22 of the present invention. One example of a suitable hook component 20 is available from Velcro, U.S.A., of Manchester, N.H., under the trade designation HTH-851. Other suitable hook components 20 are also available from Velcro, U.S.A. Individual hooks 24 typically have a base portion that extends roughly perpendicularly from the hook backing material 26 and a free end extending from the base portion that is curved or angled to enable engagement with a corresponding loop 28 on the loop component 22. The hooks 24 are typically co-formed with the hook backing material 26.

Suitable hook components 20 generally have between about 16 and about 620 hooks per square centimeter, or between about 124 and about 388 hooks per square centimeter, or between about 155 and about 310 hooks per square centimeter. The hooks 24 suitably have a height of from about 0.00254 centimeter (cm) to about 0.19 cm, or from about 0.0381 cm to about 0.0762 cm. The hooks are suitably molded or extruded from a thermoplastic polymer selected from polyamides, polyesters, polyolefins (e.g. polypropylene or polyethylene) or another suitable material. Likewise, the hook backing material 26 can be made of any of these or any other suitable materials. The hook backing material 26 generally has a thickness in a range of between about 0.5 millimeter (mm) and about 5 mm, suitably in a range of between about 0.8 mm and 3 mm, with a basis weight in a range of from about 20 grams per square meter to about 70 grams per square meter.

Figure 2:
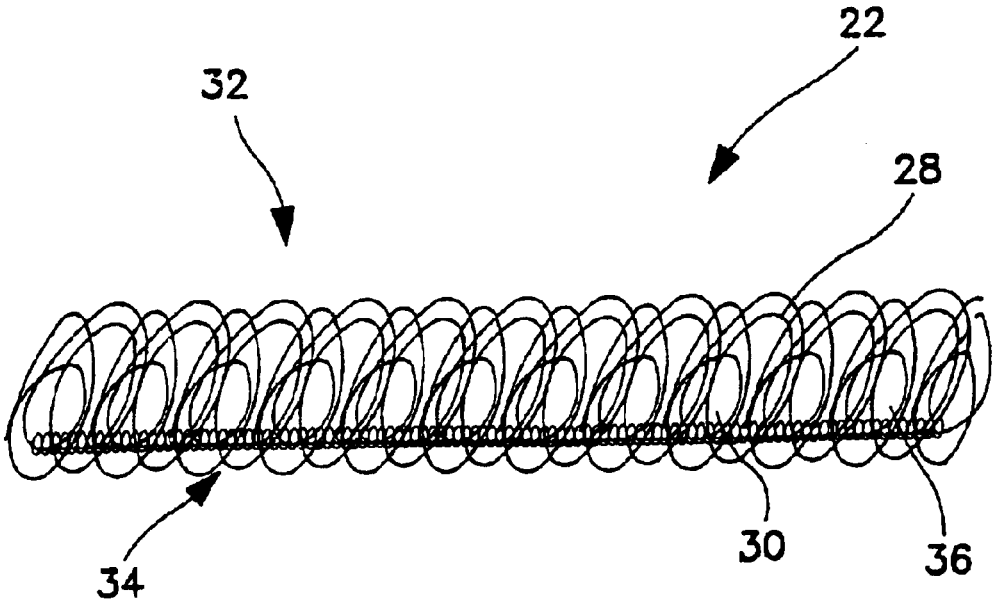
FIG. 2 is a side view of a loop component.

The loop component 22 of the present invention is essentially one layer of a thermally retractable, fibrous material, shown in FIG. 2. Alternatively, a multilayer, thermally retractable, fibrous material can be used to form the loop component 22 of the present invention. Fibers of the material form loops 28 on a first side 32 of the material and are thermally bonded on a second side 34 of the material, thereby stabilizing the fibers and creating a relatively smooth surface on the second side 34 of the material. The fibers are continuous between the first side 32 and the second side 34, such that a single fiber can form multiple loops 28 and each of the loops 28 are separated from one another by thermally bonded portions 36 of the fiber on the second side 34 of the material.

The loops 28 are not necessarily of a uniform height, but preferably have a height in a range of from about 0.00254 cm to about 0.19 cm, or from about 0.0381 cm to about 0.0762 cm. The loop backing 30 includes the bonded portions 36 of the fibrous material and is, therefore, the thickness of the thermally bonded fibers on the second side 34 of the material. Thus, the loop backing 30 is suitably no thicker than about 0.04 cm, more suitably no thicker than about 0.01 cm, even more suitably no thicker than about 0.0025 cm. The loop backing 30 should have a thickness of at least about 0.000254 cm, suitably at least about 0.000381 cm. The density of the loops 28 on the loop component 22 is largely dependent on the type of thermally retractable, fibrous material used, and can range from about 16 to about 620 loops per square centimeter, or from about 124 to about 388 loops per square centimeter, or from about 155 to about 310 loops per square centimeter.

As mentioned, the loop component 22 of the present invention is made of a thermally retractable, fibrous material. The material is suitably a nonwoven web in the form of a bonded carded web, a spunbonded web, or a meltblown web. As mentioned, the material can also be a multilayer material with, for example, at least one layer of a meltblown web and at least one layer of a spunbonded web, or any other suitable combination of nonwoven webs. The multiple layers of the multilayer material are suitably thermally bonded to one another, and can differ from one another in terms of resin, denier, basis weight, or other material characteristics or combinations thereof.

The nonwoven web, or webs, is suitably a polymer or combination of polymers, such as polyolefins, polyesters, polyamides, and elastomeric thermoplastic polymers. Examples of suitable polyolefins include polyethylene, polypropylene, polybutene, ethylene copolymers, propylene copolymers, and butene copolymers.

Suitable elastomeric thermoplastic polymers for the material of the present invention include those made from block copolymers such as polyurethanes, copolyether esters, polyamide polyether block copolymers, polyester block amide copolymers, ethylene vinyl acetates (EVA), block copolymers having the general formula A-B-A' or A-B like copoly(styrene/ethylene-butylene), styrene-poly (ethylene-propylene)-styrene, styrene-poly(ethylene-butylene)-styrene, (polystyrene/poly(ethylene-butylene)/polystyrene, poly(styrene/ethylenebutylene/styrene) and the like.

Commercial examples of suitable elastomeric copolymers are, for example, those known as KRATON® materials which are available from Shell Chemical Company of Houston, Tex. KRATON® block copolymers are available in several different formulations, a number of which are identified in U.S. Pat. Nos. 4,663,220, 4,323,534, 4,834,738, 5,093,422 and 5,304,599, hereby incorporated by reference.

Other exemplary elastomeric materials which may be used include polyurethane elastomeric materials such as, for example, those available under the trademark ESTANE® from B. F. Goodrich & Co. or MORTHANE® from Morton Thiokol Corp., polyester elastomeric materials such as, for example, those available under the trade designation HYTREL® from E. I. DuPont De Nemours & Company of Wilmington, Del., and those known as ARNITEL®, formerly available from Akzo Plastics of Arnhem, Holland and now available from DSM of Sittard, Holland.

Figure 3:
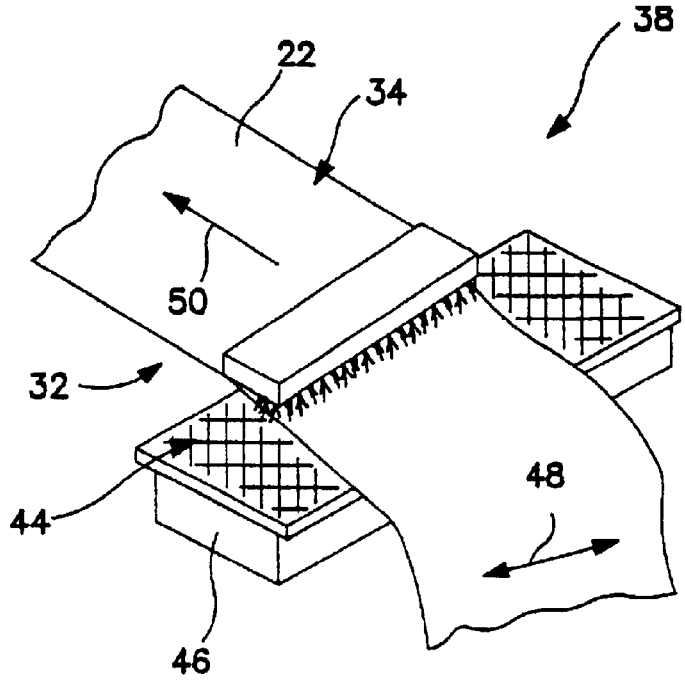
FIG. 3 is a plan view of apparatus for making a loop component.
Figure 4:
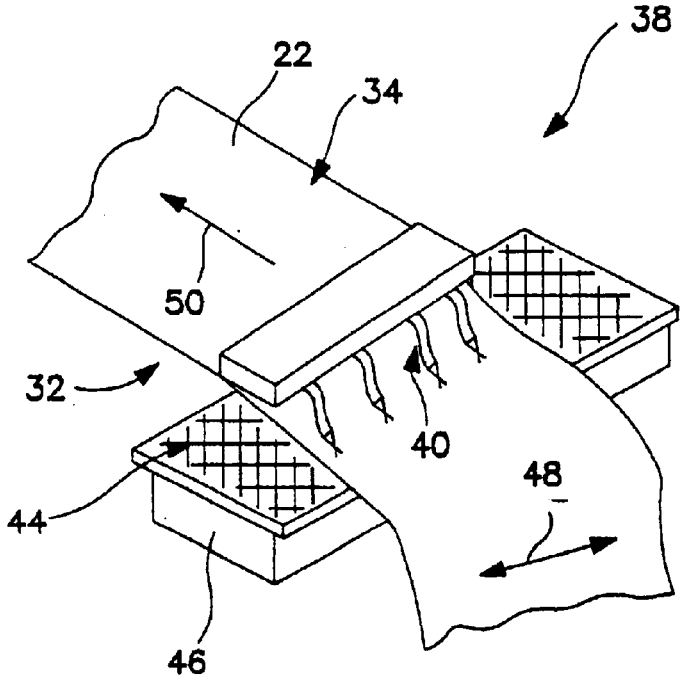
FIG. 4 is a plan view of apparatus, including a zoned hot air knife, for making a loop component.

The loop component 22 can be produced by applying heat to the second side 34 of the thermally retractable, fibrous material, as illustrated by the apparatuses 38 shown in FIGS. 3 and 4. The heat can be applied using a device 40 such as a hot air knife, infrared heat, a floatation oven, or any other suitable means. As used herein, the term "hot air knife" refers to a device through which a stream of heated air under pressure can be emitted and directed. With such a device, it is also possible to control the air flow of the resultant jet of heated air. A conventional hot air knife is described in U.S. Pat. No. 4,567,796 issued Feb. 04, 1986, hereby incorporated by reference. A zoned hot air knife, in which the hot air can be applied to spaced apart zones, is described in U.S. Pat. No. 6,066,221 issued May 23, 2000, hereby incorporated by reference. The apparatus 38 in FIG. 3 shows heat being applied continuously over an entire width of the thermally retractable, fibrous material. The apparatus 38 in FIG. 4 shows the hot air knife 40 applying heat in spaced apart zones over the width of the thermally retractable, fibrous material, thereby resulting in a loop component 22 have spaced apart zones of loops 28 interspersed between zones free of loops 28.

The heat is hot enough to cause the second (exposed) side 34 of the material to retract and to cause the fibers on the second side 34 of the material to bond together or at least become thermally stabilized. More specifically, the temperature of the heat is within ±5° C. of a melting point of the material. When using the hot air knife 40, the material passes beneath the hot air knife 40 at a line speed in a range of about 100–3000 feet per minute, more commonly about 500–2500 feet per minute, desirably about 1000–2000 feet per minute.

Generally, the air velocity from the hot air knife 40 is about 1,000–25,000 feet per minute, preferably about 5,000–20,000 feet per minute, more preferably about 8,000–15,000 feet per minute. The material is drawn in the heated state and quenched in the drawn state, thereby causing the material to retract. Typically, when exposed to the heat of the hot air knife, the material tends to retract in the cross direction. However, the material can retract in any suitable direction. The cross direction is indicated by an arrow 48, and the machine direction is indicated by an arrow 50 in FIGS. 3 and 4.

Figure 5:
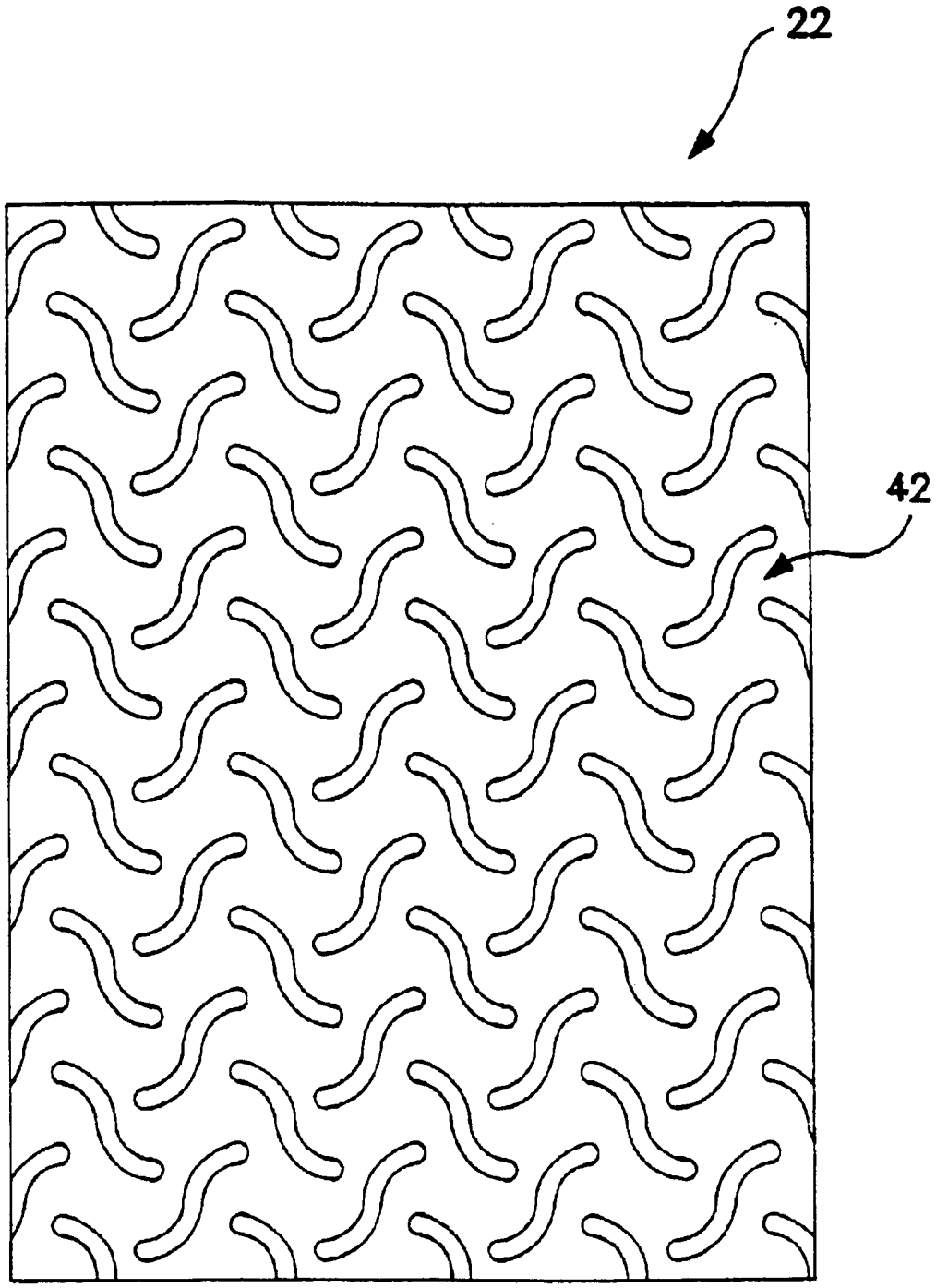
FIG. 5 is a top view of a loop component having an S-weave bond pattern.

The amount of retraction should be about 10% to about 40% of the starting material length and/or width, suitably about 15% to about 35% of the starting material length and/or width, most suitably about 20% to about 30% of the starting material length and/or width. When the material retracts, fibers on the first side 32 of the material are gathered, thus forming loops 28. Desirably, the nonwoven material has a pre-existing inter-fiber bond pattern, such as a thermal bond pattern in a spunbond web. One example of a suitable bond pattern 42 is an S-weave, as illustrated in FIG. 5. Another suitable interfiber bond pattern includes delta bonding. The advantage of having a pre-existing interfiber bond pattern is to better define the spacing and dimensions of the loops 28, which tend to appear between the bonded regions.

As shown in FIGS. 3 and 4, the material can be held on a forming wire 44 with a vacuum 46 while heat is applied to the second side 34 of the material. The vacuum 46 can be controlled, i.e., turned up, down or off, to allow the heated material to move in a direction of retraction. The forming wire 44 can be altered by forming a pattern on a surface of the forming wire 44 with grooves, apertures, indentations, or the like, such that when the heat is applied to the second side 34 of the material, only the portions of the material in contact with the patterned forming wire 44 are thermally retracted. Using a patterned forming wire 44 results in a patterned loop component 22.

A bond pattern, such as the S-weave bond pattern 42 shown in FIG. 5, can be applied to the material during the thermal bonding process. The S-weave bond pattern 42 and other suitable bond patterns are described in U.S. Pat. No. 5,964,742 issued 12 Oct. 1999, hereby incorporated by reference. Desirably, about 10 to 25% of the spunbond web is bonded with the S-weave pattern.

The loop component 22 of the present invention maintains the softness of the raw material on the first side 32 of the material. The loop component 22 is made of at least one layer of material, without any mechanical stretching and without the use of adhesives or any other type of bonding mechanism other than heat. Thus, the method of the invention is a highly efficient, highly economical way to make a functional loop component 22.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention, which is defined in the following claims and all equivalents thereto. Further, it is recognized that many embodiments may be conceived that do not achieve all of the advantages of some embodiments, particularly of the preferred embodiments, yet the absence of a particular advantage shall not be construed to necessarily mean that such an embodiment is outside the scope of the present invention.

I claim:

1. A hook and loop fastener comprising a hook component and a loop component;

the hook component including a hook backing and a plurality of hooks protruding from it;

the loop component including a layer of a first thermally retracted material with a plurality of looped fibers on a first side of the first material, and a layer of a second thermally retracted material with a plurality of thermally stabilized fibers on a second side of the second material, wherein the first thermally retracted material and the second thermally retracted material are thermally bonded to one another.

2. The hook and loop fastener of claim 1, wherein the first retracted material and the second retracted material comprise different deniers from one another.

3. The hook and loop fastener of claim 1, wherein the first retracted material and the second retracted material comprise different basis weights from one another.

4. The hook and loop fastener of claim 1, wherein the first retracted material and the second retracted material comprise different resins from one another.

5. The hook and loop fastener of claim 1, wherein the first retracted material and the second retracted material each comprise a thermally retracted nonwoven web.

6. The hook and loop fastener of claim 5, wherein the thermally retracted nonwoven web of both the first retracted material and the second retracted material is selected from the group consisting of a bonded carded web, a spunbonded web, and a meltblown web.

7. The hook and loop fastener of claim 6, wherein each of the thermally retracted nonwoven webs comprises a polymer selected from the group consisting of polyolefins, polyesters, polyamides, and elastomeric thermoplastic polymers.

8. The hook and loop fastener of claim 7, wherein the polymer of each material comprises a polyolefin selected from the group consisting of one or more of polyethylene, polypropylene, polybutene, ethylene copolymers, propylene copolymers, and butene copolymers.

* * * * *